US008977166B2

(12) United States Patent
Matsuura

(10) Patent No.: US 8,977,166 B2
(45) Date of Patent: Mar. 10, 2015

(54) IMAGE FORMING APPARATUS

(75) Inventor: Taizo Matsuura, Ama (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 268 days.

(21) Appl. No.: 13/232,007

(22) Filed: Sep. 14, 2011

(65) Prior Publication Data

US 2012/0107017 A1 May 3, 2012

(30) Foreign Application Priority Data

Oct. 29, 2010 (JP) ..... 2010-244232

(51) Int. Cl.
*G03G 15/02* (2006.01)

(52) U.S. Cl.
CPC .... *G03G 15/0291* (2013.01); *G03G 2215/0141* (2013.01)
USPC ..... 399/171

(58) Field of Classification Search
CPC ..... G03G 15/0291; G03G 2215/0141
USPC ..... 399/168–173
See application file for complete search history.

(56) References Cited

U.S. PATENT DOCUMENTS

| | | | | |
|---|---|---|---|---|
| 5,845,179 | A * | 12/1998 | Damji et al. | 399/173 |
| 6,061,537 | A | 5/2000 | Nakajima et al. | |
| 2003/0190539 | A1* | 10/2003 | Niimi | 430/58.7 |
| 2008/0019719 | A1* | 1/2008 | Kleckner | 399/50 |
| 2010/0239315 | A1 | 9/2010 | Hazeyama | |

FOREIGN PATENT DOCUMENTS

| | | | | |
|---|---|---|---|---|
| JP | 05-081851 U | 11/1993 | | |
| JP | 05-286172 A | 11/1993 | | |
| JP | 08-044154 A | 2/1996 | | |
| JP | 08030071 A | * 2/1996 | | G03G 15/02 |
| JP | 11-174772 A | 7/1999 | | |
| JP | 2002-072597 A | 3/2002 | | |
| JP | 2006-184751 | 7/2006 | | |
| JP | 2010-224109 | 10/2010 | | |

OTHER PUBLICATIONS

Machine translations of Iwata et al, H 08-030071, and Osugi, JP 2002-072597.*
Machine translation of Osawa, JP H08-044154 (1996).*
JP Office Action mailed Feb. 5, 2013, JP Appln. 2010-244232, English translation.

* cited by examiner

*Primary Examiner* — David Gray
*Assistant Examiner* — Sevan A Aydin
(74) *Attorney, Agent, or Firm* — Banner & Witcoff, Ltd.

(57) ABSTRACT

An image forming apparatus includes: a photosensitive drum configured to rotate about a rotational axis extending in an axial direction; and a charger that charges the photosensitive drum. The charger includes: a wire electrode; a grid electrode having a grid surface that faces the photosensitive drum between the wire electrode and the photosensitive drum; and a pair of shield electrodes, which faces each other with interposing the wire electrode therebetween, and which extends in a substantially orthogonal direction to the grid electrode. The grid surface is inclined to a second plane such that the grid electrode and the shield electrode come close to the photosensitive drum at a more downstream side in a rotating direction of the photosensitive drum than a first plane, wherein the first plane includes the wire electrode and the rotational axis of the photosensitive drum, and the second plane is orthogonal to the first plane.

7 Claims, 3 Drawing Sheets

IMAGE FORMING APPARATUS

CROSS-REFERENCE TO RELATED APPLICATIONS

This application claims priority from Japanese Patent Application No. 2010-244232 filed on Oct. 29, 2010, the entire subject matter of which is incorporated herein by reference.

TECHNICAL FIELD

The invention relates to an image forming apparatus having a charger that charges a photosensitive drum.

BACKGROUND

There has been proposed a related-art image forming apparatus that includes a charger having a discharge wire (wire electrode) and a grid electrode and generating the corona discharge from the wire electrode in order to charge a surface of a photosensitive drum. In the related-art image forming apparatus, the charger is arranged such that the grid electrode (grid surface opposed to the photosensitive drum) is orthogonal to a plane including the wire electrode and a rotational center portion of the photosensitive drum.

SUMMARY

Illustrative aspects of the invention provide an image forming apparatus capable of reducing a size thereof.

BRIEF DESCRIPTION OF THE DRAWINGS

FIG. 3A shows a configuration of a comparative example in which a grid surface is arranged in parallel with an orthogonal plane and FIG. 3B shows a configuration of an exemplary embodiment in which the grid surface is inclined to the orthogonal plane.

DETAILED DESCRIPTION

<General Overview>

Figure 1:
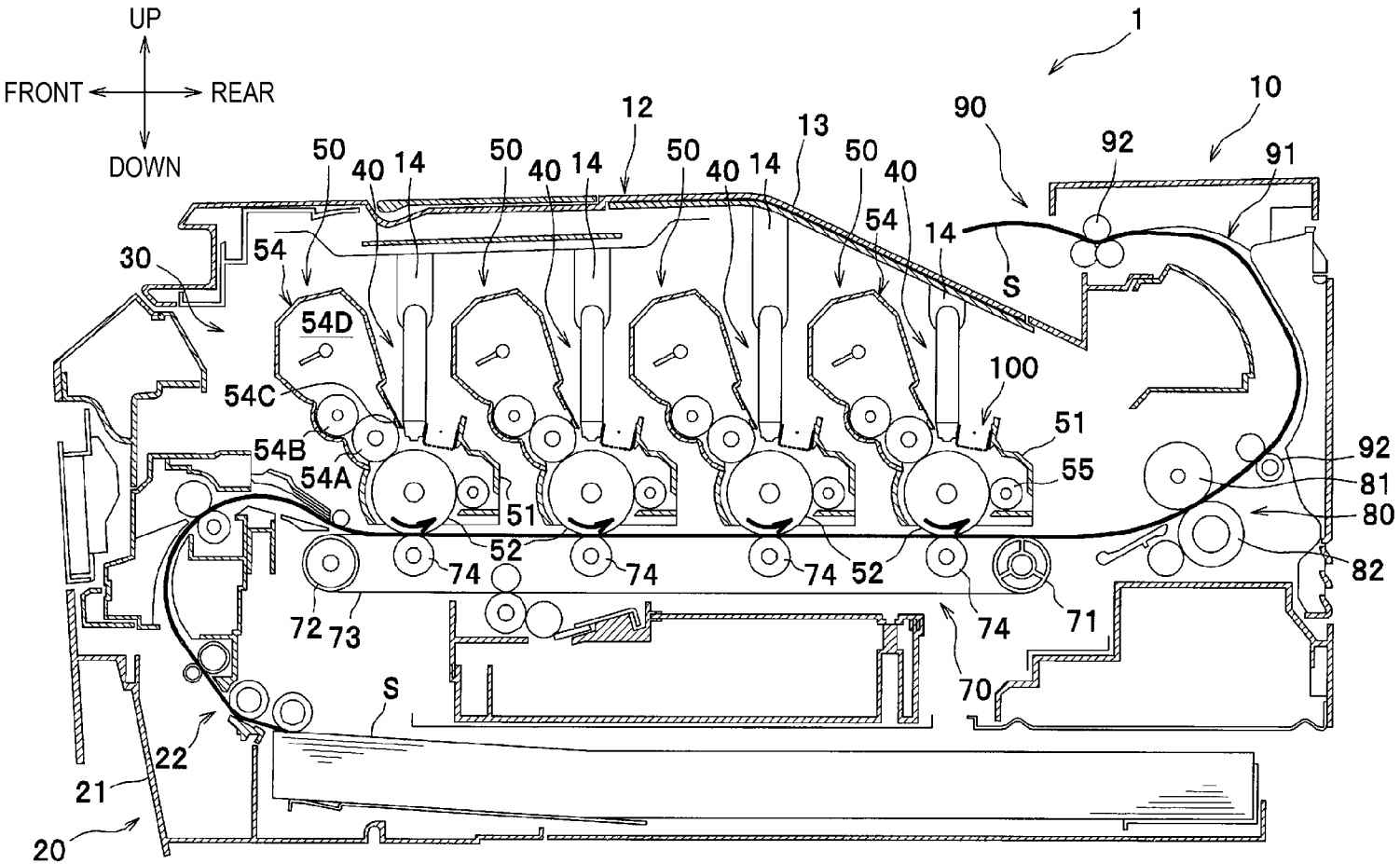
FIG. 1 is a view showing an overall configuration of a color printer according to an exemplary embodiment of the invention.

In recent years, as a size of the image forming apparatus is reduced, a diameter of the photosensitive drum is also made to be smaller. However, since the photosensitive drum has, on a circumferential surface thereof, an exposure position to be exposed by an exposure device and the charger, a developing roller, a transfer roller, a cleaning roller and the like are arranged around the photosensitive drum, gaps therebetween are reduced as the diameter of the photosensitive drum is made to be smaller. Specifically, since there is a limit to the miniaturization of the charger, there is also a limit to the miniaturization of the photosensitive drum (reducing a size of the image forming apparatus).

Therefore, illustrative aspects of the invention provide an image forming apparatus capable of reducing a size thereof.

According to illustrative aspects of the invention, there is provided an image forming apparatus comprising: a photosensitive drum configured to rotate about a rotational axis extending in an axial direction; and a charger configured to charge the photosensitive drum, wherein the charger comprises: a wire electrode, which extends in the axial direction, and to which a voltage for exposing the photosensitive drum is applied; a grid electrode having a grid surface that faces the photosensitive drum between the wire electrode and the photosensitive drum; and a pair of shield electrodes, which is arranged to face each other with the wire electrode being interposed therebetween, and which extends in a substantially orthogonal direction to the grid electrode, and wherein the grid surface is inclined to a second plane such that the grid electrode and one of the pair of shield electrodes come close to the photosensitive drum at a more downstream side in a rotating direction of the photosensitive drum than a first plane, wherein the first plane includes the wire electrode and the rotational axis of the photosensitive drum, and the second plane is an orthogonal plane to the first plane.

According to the image forming apparatus configured as described above, the grid surface is inclined to the orthogonal plane of the plane including the wire electrode and the rotational center portion of the photosensitive drum such that the grid electrode and the shield electrode come close to the photosensitive drum at the more downstream side in the rotating direction of the photosensitive drum than the plane including the wire electrode and the rotational center portion of the photosensitive drum. Accordingly, an end portion, which faces the photosensitive drum, of the shield electrode of the charger, which shield electrode is positioned at the downstream side in the rotating direction of the photosensitive drum, can be made to be distant from an optical axis of the exposing light. Thereby, it is possible to secure a space between the charger and the optical axis of the exposing light, and thus it is possible to closely arrange the charger to the optical axis so as to make a diameter of the photosensitive drum smaller. As a result, the size of the image forming apparatus can be further reduced.

In addition, the grid electrode is inclined such that the downstream side thereof in the rotating direction of the photosensitive drum is more close to the photosensitive drum than the plane including the wire electrode and the rotational center portion of the photosensitive drum. Accordingly, a distance between the surface of the photosensitive drum and the grid electrode (grid surface) is narrower at the downstream side in the rotating direction of the photosensitive drum and is wider at the upstream side in the rotating direction. Therefore, it is possible to reduce an amount of ions (ionized air by the corona discharge) flowing toward the downstream side (toward the exposure position) in the rotating direction of the photosensitive drum. According thereto, it is possible to suppress the surface of the photosensitive drum from being re-charged after the exposure. As a result, it is possible to form a favorable image.

According to the invention, the grid electrode is inclined to the orthogonal plane to the plane including the wire electrode and the rotational center portion of the photosensitive drum so that the grid electrode and the shield electrode come close to the photosensitive drum at the downstream side in the rotating direction of the photosensitive drum. Accordingly, it is possible to make the diameter of the photosensitive drum smaller, so that it is possible to further reduce the size of the image forming apparatus.

<Exemplary Embodiments>

Hereinafter, exemplary embodiments of the invention will now be described with reference to the drawings. In the following descriptions, a configuration of an image forming apparatus 1 will be briefly described and then the characteristics of the invention will be described. Incidentally, a color printer is one example of the image forming apparatus 1.

Also, in the following descriptions, the directions are described on the basis of a user who uses the image forming apparatus 1. That is, the left side of FIG. 1 is referred to as the 'front side', the right side is referred to as the 'rear side', the front side is referred to as the 'right side' and the inner side is referred to as the 'left side.' Also, the upper-lower direction of FIG. 1 are referred to as the 'upper-lower' direction.

(Overall Configuration of Image Forming Apparatus)

As shown in FIG. 1, the image forming apparatus 1 includes, in a body casing 10, a feeder unit 20 that feeds sheets S, an image forming unit 30 that forms an image on the fed sheet S and a sheet discharge unit 90 that discharges the sheet S having an image formed thereon.

An upper cover 12 is provided to an upper side of the body casing 10. The upper cover 12 is configured to be rotatable (opened and closed) about the rear side serving as a support point. A sheet discharge tray 13, on which the sheet S discharged from the body casing 10 is put, is provided on an upper surface of the upper cover 12. Four holding members 40 that hold LED units 40 are provided on a lower surface of the upper cover.

The feeder unit 20 is provided at the lower part in the body casing 20. The feeder unit 20 includes a feeder tray 21, which receives therein the sheets S, and a sheet feeding mechanism 22, which feeds the sheet S from the feeder tray 21 to the image forming unit 30. The sheets S in the feeder tray 21 are separated one at a time by the sheet feeding mechanism 22 and are then supplied to the image forming unit 30.

The image forming unit 30 includes four LED units 40 that are an example of an exposure device, four process units 50, a transfer unit 70 and a fixing unit 80.

The LED unit 40 is opposed to the upper part of a photosensitive drum 52 at a closed state of the upper cover 12. The LED unit 40 is configured to expose a surface of the photosensitive drum 52. The LED unit 40 is held at the upper cover 12 by the holding member 14, so that the LED unit 40 is spaced from the photosensitive drum 52 as the upper cover 12 is opened. The LED unit 40 will be specifically described later.

The process units 50 are arranged in parallel with each other in the front-rear direction between the upper cover 12 and the feeder unit 20. The process units 50 are detachably mounted to the body casing 10 at an opened state of the upper cover 12. The process unit 50 includes a process frame 51, the photosensitive drum 52, a charger 100, a developing device 54 and a cleaning roller 55.

The process frame 51 rotatably supports the photosensitive drum 52 and the cleaning roller 55. Further, the process frame 51 supports a wire electrode 110, a grid electrode 120 and shield electrodes 131, 132 of the charger 100, which will be described later.

The photosensitive drum 52 has a photosensitive layer formed on a surface (outer peripheral surface) of a cylindrical drum body having conductivity. The photosensitive drum 52 is configured to rotate in a counterclockwise direction (arrow direction) of FIG. 1.

The charger 100 is a scorotron-type charger that charges the surface of the photosensitive drum 52. The charger 100 is arranged obliquely upper-rear side of the photosensitive drum 52 and faces the photosensitive drum 52.

The developing device 54 is detachably mounted to the process frame 51. The developing device 54 is arranged obliquely upwards to the front of the photosensitive drum 52 at the mounted state to the process frame 51. The developing device 54 includes a developing roller 54A that is an example of a developer carrier to supply toner (developer) to the photosensitive drum 52, a supply roller 54B, a layer thickness regulation blade 54C and a toner accommodating part 54D that accommodates the toner therein.

The cleaning roller 55 collects foreign substances such as paper dusts and dusts adhered on the surface of the photosensitive drum 52, the toner remained on the surface of the photosensitive drum 52 and the like. The cleaning roller 55 is arranged to contact the rear part of the photosensitive drum 52.

The transfer unit 70 is provided between the feeder unit 20 and the process unit 50. The transfer unit 70 includes a driving roller 71, a driven roller 72 and an endless conveyance belt 73 extending between the driving roller 71 and the driven roller 72. The conveyance belt 73 contacts an outer surface of the respective photosensitive drums. At the inner side of the conveyance belt, the respective transfer rollers 74 are arranged to interpose the conveyance belt 73 between the respective transfer rollers and the respective photosensitive drums 52. The fixing unit 80 is provided at the rear part of the process unit 50 and the transfer unit 70. The fixing unit 80 includes a heating roller 81 and a pressing roller 82, which is opposed to the heating roller 81 and presses the heating roller 81.

In the image forming unit 30, the surface of the photosensitive drum 52 is uniformly charged by the charger 100 and is then exposed by the LED unit 40, so that an electrostatic latent image is formed on the photosensitive drum 52 based on image data. In addition, the toner in the toner accommodating part 54D is supplied to the developing roller 54A through the supply roller 54B, is introduced between the developing roller 54A and the layer thickness regulation blade 54C and is then carried on the developing roller 54A as a thin layer having a predetermined thickness.

The toner carried on the developing roller 54A is supplied to the photosensitive drum 52, so that the electrostatic latent image is visualized and a toner image is thus formed on the photosensitive drum 52. After that, as the sheet S fed from the feeder unit 20 is conveyed between the photosensitive drums 52 and the conveyance belt 73 (transfer rollers 74), the toner images formed on the respective photosensitive drums 52 are sequentially overlapped and transferred on the sheet S. The sheet S, to which the toner images are transferred, is conveyed between the heating roller 81 and the pressing roller 82, so that the toner images are heated and fixed.

The sheet discharge unit 90 includes a sheet discharge path 91, which guides the sheet S conveyed from the fixing unit 80, and a plurality of conveyance rollers 92 that conveys the sheet S. The sheet S, to which the toner images are heated and fixed, is conveyed through the sheet discharge path 91 by the conveyance rollers 92 and is discharged to the outside of the body casing 10 so as to be put on the sheet discharge tray 13.

(Configuration Around Photosensitive Drum)

In the followings, detailed configuration around the photosensitive drum 52 will be described, based on the configuration and arrangement of the LED unit 40 and the charger 100.

Figure 2:
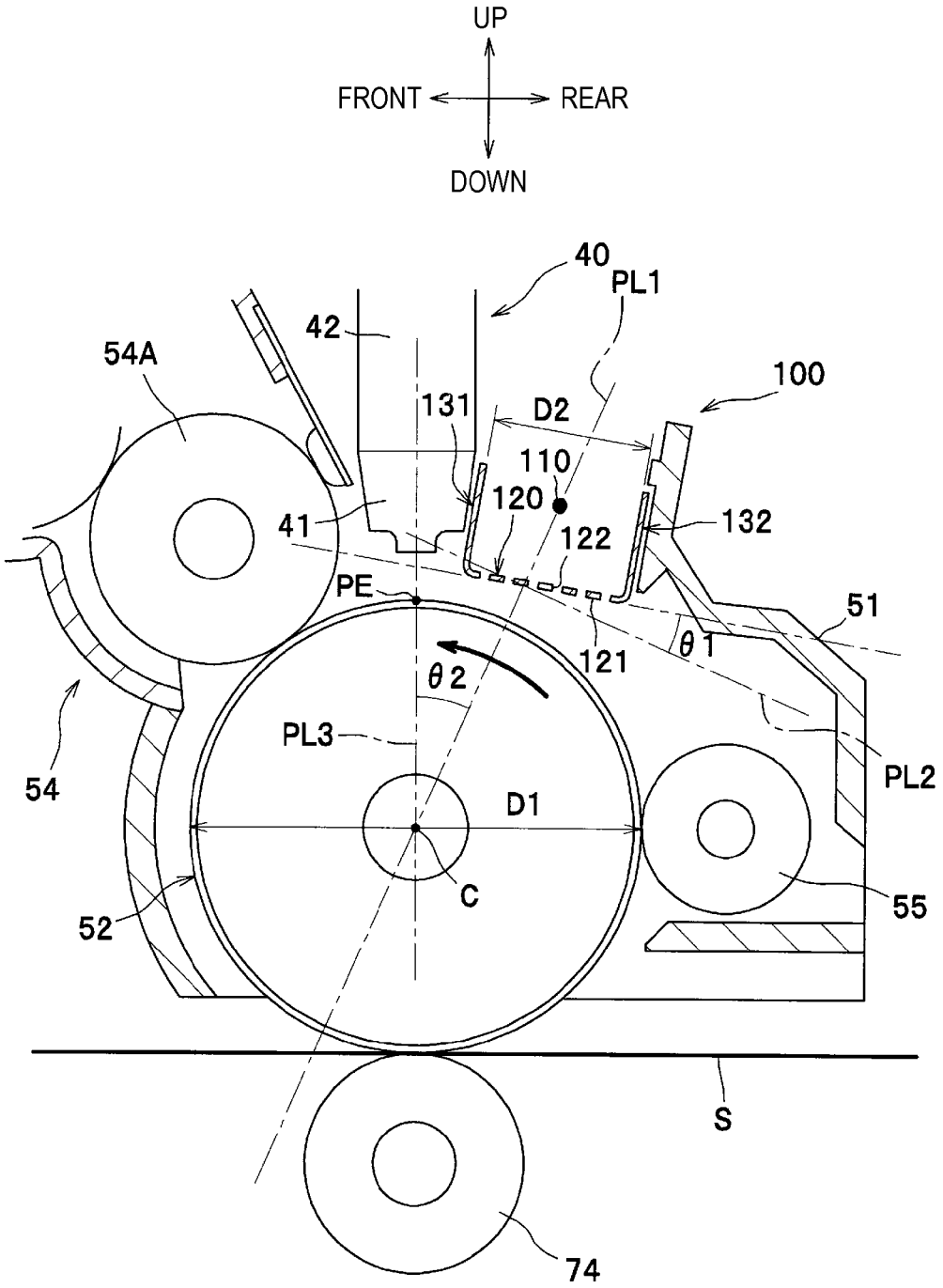
FIG. 2 is an enlarged view showing a configuration around a photosensitive drum.

As shown in FIG. 2, the LED unit 40 includes an LED head 41, which is an example of an exposure head, and a support frame 42. The LED unit 40, more specifically, the LED head 41 is arranged to face the surface of the photosensitive drum 52 between the developing roller 54A (developing device 54) and the charger 100.

The LED head 41 extends in the left-right direction (axial direction of the photosensitive drum 52). A lower end (leading end) of the LED head 41 is arranged adjacent to the surface of the photosensitive drum 52 at the closed state of the upper cover 12. A plurality of light emitting parts (LEDs) (not shown) is arranged at the leading end of the LED head 41 in the left-right direction. In the invention, the light emitting parts may be linearly arranged or zigzag-arranged in the left-right direction. In addition, the row of the light emitting parts may be one or two or more rows of the light emitting parts may be provided side by side in the front-rear direction. The support frame 42 supports the LED head 41 to the upper cover 12. An upper part of the support frame 42 is mounted to the upper cover 12 through the holding member 14 while a lower part thereof supports the LED unit 41.

The LED unit 40 turns on and off the light emitting parts on the basis of the image data so as to expose the surface of the charged photosensitive drum 52. In the following descriptions, a part of the surface of the photosensitive drum 52, which is exposed by the LED unit 40, is referred to as an exposure position PE. In this exemplary embodiment, an intersection point (intersection line) of the surface of the photosensitive drum 52 and an optical axis of the exposing light emitted from the LED head 41, when seen from the left-right direction, is the exposure position PE.

Incidentally, when the light emitting parts of the LED head 41 are zigzag-arranged or two or more rows of the light emitting parts are arranged side by side, a plurality of optical axes is formed when seen from the left-right direction. In this case, regarding the circumferential direction of the photosensitive drum 52, a middle position between an intersection of the surface of the photosensitive drum 52 and the optical axis at the most upstream side in the rotating direction of the photosensitive drum 52 and an intersection of the surface of the photosensitive drum 52 and the optical axis at the most downstream side in the rotating direction is the exposure position.

The charger 100 includes the wire electrode 110, the grid electrode 120 and a pair of shield electrodes 131, 132. The charger 100 is arranged obliquely upper-rear side of the photosensitive drum 52 and faces the photosensitive drum 52 at a predetermined distance from the surface of the photosensitive drum 52.

The wire electrode 110 is a metal wire that generates the corona discharge as a voltage for exposing the photosensitive drum 52 is applied. The wire electrode 110 is installed in parallel with the rotational axis (rotational center portion C) of the photosensitive drum 52 and extends in the left-right direction between the pair of shield electrodes 131, 132.

The grid electrode 120 is a metal plate member that is set with a potential (including zero potential) different from that of the wire electrode 110 so as to control an amount of ions reaching the surface of the photosensitive drum 52. The grid electrode 120 has a planar grid surface 121 that is opposed to the photosensitive drum 52 between the wire electrode 110 and the photosensitive drum 52. The grid surface 121 extends in the left-right direction. The grid surface 121 includes a plurality of grid holes 122 for enabling the ions generated by the corona discharge of the wire electrode 110 to pass therethrough.

The shield electrodes 131, 132 are metal plate members that are arranged to face each other with the wire electrode 110 being interposed therebetween, when seen from the left-right direction, and extend in a substantially orthogonal direction to the grid electrode 120 (grid surface 121). The shield electrodes 131, 132 have the substantially long plate shapes extending along the rotational center portion C (the left-right direction) of the photosensitive drum 52 and are arranged in parallel with each other. Incidentally, in this exemplary embodiment, the shield electrodes 131, 132 are integrated with the grid electrode 120. However, the invention is not limited thereto. For example, the shield electrodes may be parts different from the grid electrode 120.

In the following descriptions, one of the shield electrodes 131, 132, which is arranged at the downstream side (front side) of the photosensitive drum 52 in the rotating direction, is referred to as a front-side shield electrode 131, and another one of the shield electrodes 131, 132, which is arranged at the upstream side (back side) in the rotating direction, is referred to as a back-side shield electrode 132.

In this exemplary embodiment, the charger 100, more specifically, the grid surface 121 is inclined to an orthogonal plane PL2 of a plane PL1 including the wire electrode 110 and the rotational center portion C of the photosensitive drum 52 so that the grid electrode 120 and the front-side shield electrode 131 are close to the photosensitive drum 52 at a front side than the plane PL1.

Figure 3A:
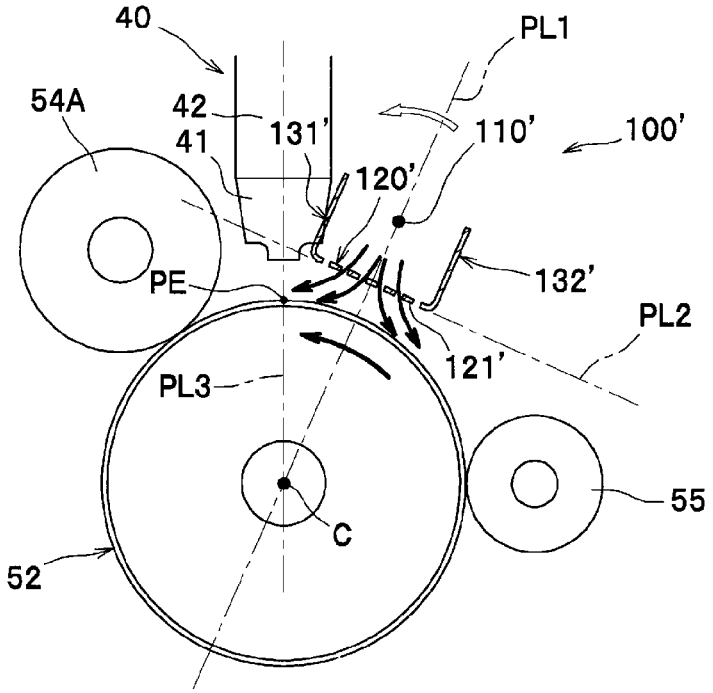
FIGS. 3A-3B illustrate effects of the invention, where
Figure 3B:
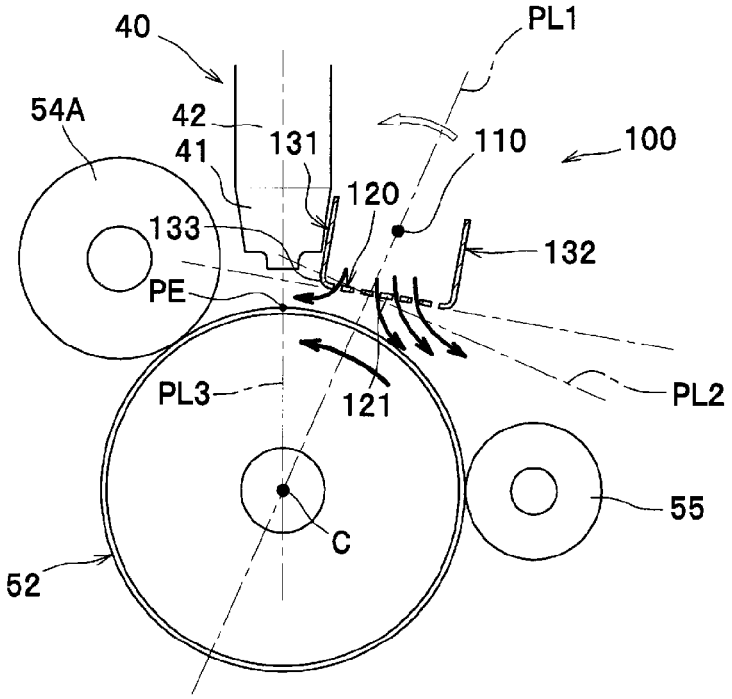

The charger 100 is arranged as described above. Thereby, the configuration of this exemplary embodiment shown in FIG. 3B enables a lower end portion 133 of the front-side shield electrode 131 to be more distant from the LED unit 40 (optical axis of the exposing light (refer to a plane PL3)), compared to a configuration shown in FIG. 3A in which a grid surface 121' of a charger 100' is arranged along the orthogonal plane PL2. According to this configuration, it is possible to secure a space between the charger 100 and the LED unit 40, and thus it is possible to closely arrange the charger 100 and the LED unit 40, as shown in FIG. 3B. Therefore, it is possible to make a diameter of the photosensitive drum 52 smaller, so that it is possible to further reduce the size of the image forming apparatus 1.

Incidentally, as shown in FIG. 2, an angle θ1 between the grid surface 121 and the orthogonal plane PL2 is preferably equal to or more than 5 degrees and equal to or less than 15 degrees. According to this configuration, it is possible to favorably charge the surface of the photosensitive drum 52 while inclining the charger 100 (grid surface 121).

In addition, an angle θ2 between the plane PL1 and the plane PL3 including the rotational center portion C of the photosensitive drum 52 and the exposure position PE is preferably equal to or less than 30 degrees. According to this configuration, since the charger 100 and the LED unit 40 come closer to each other, it is possible to make the diameter of the photosensitive drum 52 much smaller. As a result, it is possible to further reduce the size of the image forming apparatus 1.

Furthermore, the diameter D1 of the photosensitive drum 52 is preferably equal to or less than 18 mm. At this time, a distance D2 between the shield electrodes 131, 132 is preferably equal to or more than 7 mm. According to this configuration, since the spark can be prevented from being occurred, it is possible to stabilize the corona discharge.

In this exemplary embodiment, the grid electrode 120 is inclined so that the front side thereof than the plane PL1 is close to the photosensitive drum 52. Accordingly, a distance between the surface of the photosensitive drum 52 and the grid surface 121 is narrower at the front side than the plane PL1 and is wider at the back side than the plane PL1. Therefore, the configuration of this exemplary embodiment shown in FIG. 3B can reduce the amount of ions flowing toward the LED head 41 (refer to the arrows), compared to the configuration shown in FIG. 3A. Thereby, it is possible to suppress the surface of the photosensitive drum 52 from being recharged after the exposure. Hence, it is possible to make a difference of potentials of the exposed part and the non-exposed part greater, so that it is possible to form a favorable image.

The invention configured as described above is particularly useful in the configuration in which the exposure device is arranged to face the photosensitive drum 52 between the developing roller 54A and the charger 100, as the image forming apparatus 1. That is, according to such configuration, it is not easy to make the diameter of the photosensitive drum 52 smaller, compared to a configuration in which the laser light is illuminated from an exposure device arranged above a plurality of process units to expose the photosensitive drums. Accordingly, by applying the invention to the image forming apparatus having the configuration such as the image forming apparatus 1, it is possible to make the diameter of the photosensitive drum smaller and to thus further reduce the size of the image forming apparatus 1.

Although the exemplary embodiment of the invention has been described, the invention is not limited thereto. The specific configuration can be appropriately changed without departing from the scope of the invention.

In the above-described exemplary embodiment, the front-side shield electrode 131 faces the LED unit 40. However, the invention is not limited thereto. For example, a frame wall of the charger 100 supporting the shield electrodes 131, 132 and the grid electrode 120 may be provided between the front-side shield electrode 131 and the LED unit 40. Incidentally, when the invention is applied to such a configuration, the frame wall is also inclined to the orthogonal plane PL2 together with the shield electrodes 131, 132 and the grid electrode 120.

In the above-described exemplary embodiment, in the process unit 50, the developing device 54 (developing roller 54A) is detachably mounted to the photosensitive drum 52. However, the invention is not limited thereto. For example, the process unit may have a configuration in which the photosensitive drum and the developing roller (developer carrier) are integrated (i.e., the detachable mounting is impossible).

In the above-described exemplary embodiment, the LED head 41 having the plurality of LEDs (light emitting parts) arranged thereto has been exemplified as the exposure head that is arranged adjacent to the surface of the photosensitive drum 52. However, the invention is not limited thereto. For example, an EL device, a fluorescent member and the like may be adopted as the light emitting part. In addition, the exposure head may be configured so that an optical shutter such as liquid crystal device, PLZT device and the like is arranged at an output side of a backlight such as fluorescent lamp, LED and the like.

In the above-described exemplary embodiment, the LED unit 40 has been exemplified as the exposure device that is arranged to face the photosensitive drum 52 between the developing roller 54A (developer carrier) and the charger 100. However, the invention is not limited thereto. For example, the exposure device that is arranged to face the photosensitive drum between the developer carrier and the charger may be a laser scanner that is provided in correspondence to each photosensitive drum and scans the laser light on the surface of the photosensitive drum at high speed and thus exposes the surface of the photosensitive drum after the charge.

In addition, the exposure device is not limited to the configuration in which it is arranged to face the photosensitive drum between the developer carrier and the charger. For example, one exposure device (laser scanner and the like) may be arranged above the plurality of processing units (photosensitive drums).

The image forming apparatus 1 may not be limited to the color printer. For example, the image forming apparatus 1 may be a printer that forms a black-white image. Alternatively, the image forming apparatus 1 may be a copier or multi-function device.

What is claimed is:

1. An image forming apparatus comprising:

a photosensitive drum configured to rotate about a rotational axis extending in an axial direction;

a plurality of exposure devices comprising an exposure head that is arranged adjacent to a surface of the photosensitive drum; and a charger arranged adjacent to the exposure head at an upstream side of the exposure head in a rotating direction of the photosensitive drum, wherein the charger comprises:

a wire;

a pair of shield electrodes, wherein each of the pair of shield electrodes is arranged to face each other with the wire being interposed therebetween; and a grid having a grid surface that faces the photosensitive drum, wherein the pair of shield electrodes comprises:

a first shield electrode arranged at a downstream side of the wire in the rotating direction of the photosensitive drum; and a second shield electrode arranged at an upstream side of the wire in the rotating direction of the photosensitive drum, wherein a length of the first shield electrode and a length of the second shield electrode in a direction orthogonal to the grid are the same, wherein the grid linearly connects a distal end of the first shield electrode at a photosensitive member side and a distal end of the second shield electrode at the photosensitive member side, wherein the first shield electrode and the second shield electrode are orthogonal to the grid surface, wherein the grid is inclined with respect to a second plane that is orthogonal to a first plane, wherein the first plane includes the wire and the rotational axis of the photosensitive drum, wherein a distance between an end portion of the grid at the downstream side in the rotating direction of the photosensitive drum and the surface of the photosensitive drum is shorter than a distance between an end portion of the grid at the upstream side in the rotating direction of the photosensitive drum and the surface of the photosensitive drum, wherein a distance between the end portion of the grid at the downstream side in the rotating direction of the photosensitive drum and the surface of the photosensitive drum is shorter than a distance between a leading end portion of the exposure head and the surface of the photosensitive drum, wherein a second angle between the first plane and a third plane is more than a first angle between the grid surface and the second plane, wherein the third plane includes the rotation axis of the photosensitive drum and an exposure position on the surface of the photosensitive drum exposed by the exposure device, and wherein each of the first angle and the second angle is more than zero degrees.

2. The image forming apparatus according to claim 1, wherein on the third plane, a distance between an extension face of the grid surface and the exposure position is shorter than a distance between a leading end of the exposure head and the exposure position.

3. The image forming apparatus according to claim 1, wherein the first angle is equal to or more than 5 degrees.

4. The image forming apparatus according to claim 3, wherein the first angle is equal to or less than 15 degrees.

5. The image forming apparatus according to claim 1, wherein the second angle is equal to or less than 30 degrees.

6. The image forming apparatus according to claim 1, wherein a diameter of the photosensitive drum is equal to or less than 18 mm.

7. The image forming apparatus according to claim 6, wherein a distance between the pair of the shield electrodes is equal to or more than 7 mm.

* * * * *